US005615572A

United States Patent [19]

Johnson et al.

[11] Patent Number: 5,615,572

[45] Date of Patent: Apr. 1, 1997

[54] HYDRAULIC TUBE BENDER

[75] Inventors: Harry F. Johnson; Sydney C. Hundley, both of Cleburne, Tex.

[73] Assignee: Hunjohn, Inc., Cleburne, Tex.

[21] Appl. No.: 529,521

[22] Filed: Sep. 18, 1995

Related U.S. Application Data

[63] Continuation-in-part of Ser. No. 371,838, Jan. 12, 1995, abandoned.

[51] Int. Cl.[6] ..... B21D 7/022

[52] U.S. Cl. ..... 72/389.1; 72/389.6

[58] Field of Search ..... 72/212, 213, 389, 72/389.1, 389.6

[56] References Cited

U.S. PATENT DOCUMENTS

| | | | |
|---|---|---|---|
| 1,505,887 | 8/1924 | Hawes . | |
| 1,530,261 | 3/1925 | Hawes . | |
| 1,964,550 | 6/1934 | Abramson et al. | 72/389 |
| 2,382,266 | 8/1945 | Simonsen | 153/38 |
| 2,880,779 | 4/1959 | Mingori | 153/33 |
| 3,018,818 | 1/1962 | Swanson | 153/48 |
| 3,124,192 | 3/1964 | Williams et al. | 153/38 |
| 3,388,574 | 6/1968 | Ignoffo | 72/389 |
| 3,429,157 | 2/1969 | Huth | 72/389 |
| 3,448,602 | 6/1969 | Stanley et al. | 72/217 |
| 3,472,056 | 10/1969 | Gregg | 72/369 |
| 3,756,058 | 9/1973 | Hamkins et al. | 72/389 |
| 3,908,425 | 9/1975 | Ware | 72/217 |
| 3,935,721 | 2/1976 | Boteler | 72/389 |
| 4,005,593 | 2/1977 | Goldberg | 72/213 |
| 4,055,069 | 10/1977 | Caporusso et al. | 72/389 |
| 4,141,235 | 2/1979 | Ishihara | 72/213 |
| 4,299,113 | 11/1981 | Belotti | 72/389 |
| 4,569,219 | 2/1986 | Threlkel et al. | 72/381 |
| 5,237,847 | 8/1993 | Owens | 72/213 |
| 5,339,670 | 8/1994 | Granelli | 72/152 |
| 5,815,401 | 8/1991 | Ireland | 72/389 |

FOREIGN PATENT DOCUMENTS

| | | | |
|---|---|---|---|
| 153622 | 4/1952 | Australia | 72/389 |

OTHER PUBLICATIONS

Catalog, Imperial Eastman, pp. 198–201,215,216 (1987).

*Primary Examiner*—David Jones
*Attorney, Agent, or Firm*—Guy V. Manning

[57] ABSTRACT

A hydraulic tube bender comprises a hydraulic cylinder adapted to cause a mandrel to reciprocate along a longitudinal axis in a first plane in which two forming dies are stationed on either side of the axis. A pneumatic cylinder coupled to the axles of the forming dies and applies torque through a tether and pulley system to the forming dies. As the tube engages both the mandrel and the forming dies, resistive pressure in the pneumatic cylinder applies torque to the forming dies to hold them against the tube during the bending operation. A clamp may be applied to the tube to keep it snug against the mandrel as the forming dies rotate along the sides of the tube during bending. The torque system applies continuous pressure to the tube and permits bending of extremely thin walled tubing such as titanium aircraft tubing without wrinkling.

15 Claims, 6 Drawing Sheets

Fig. 2
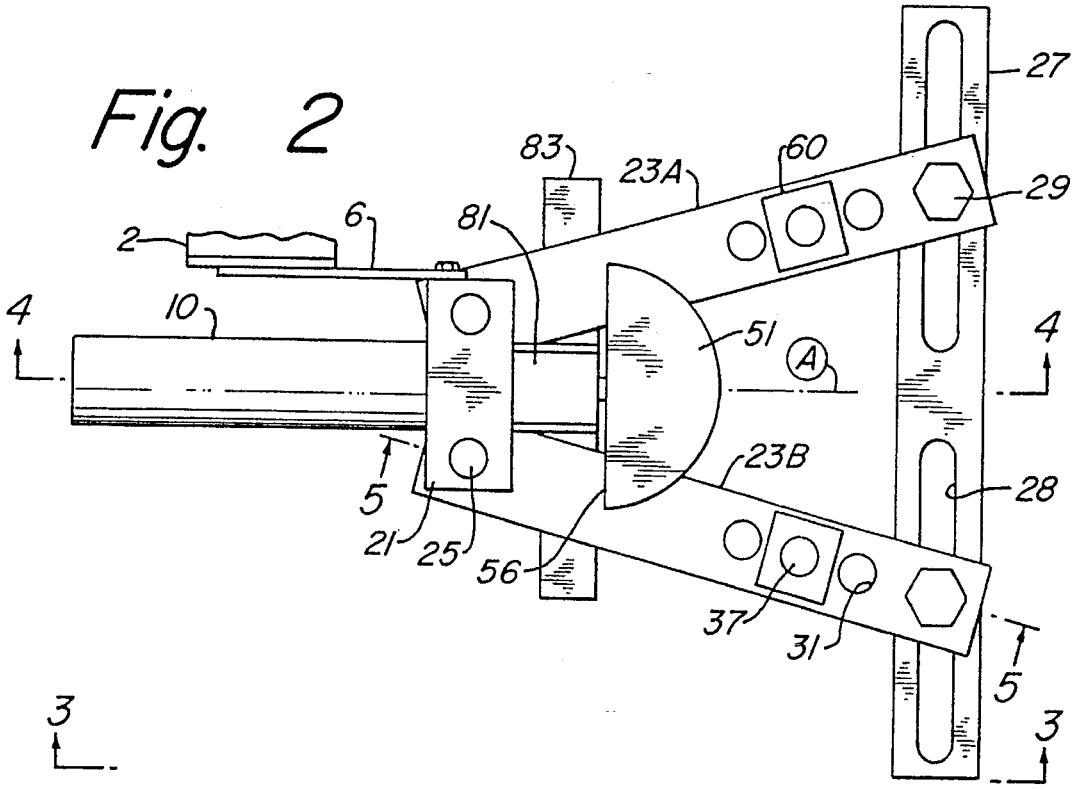
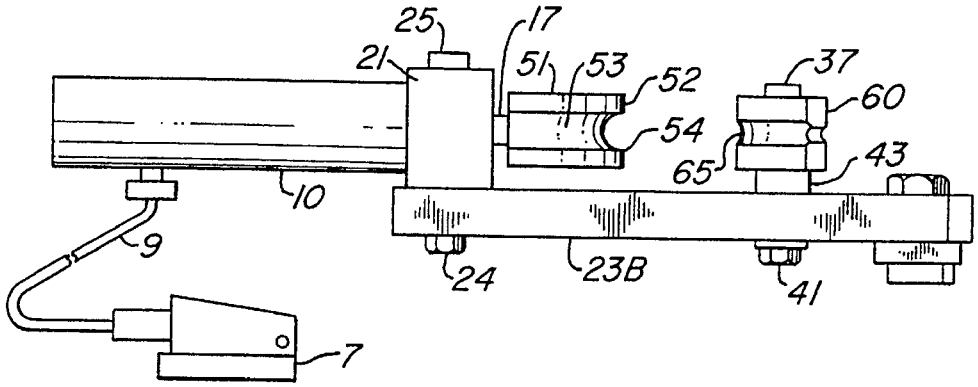
Fig. 3
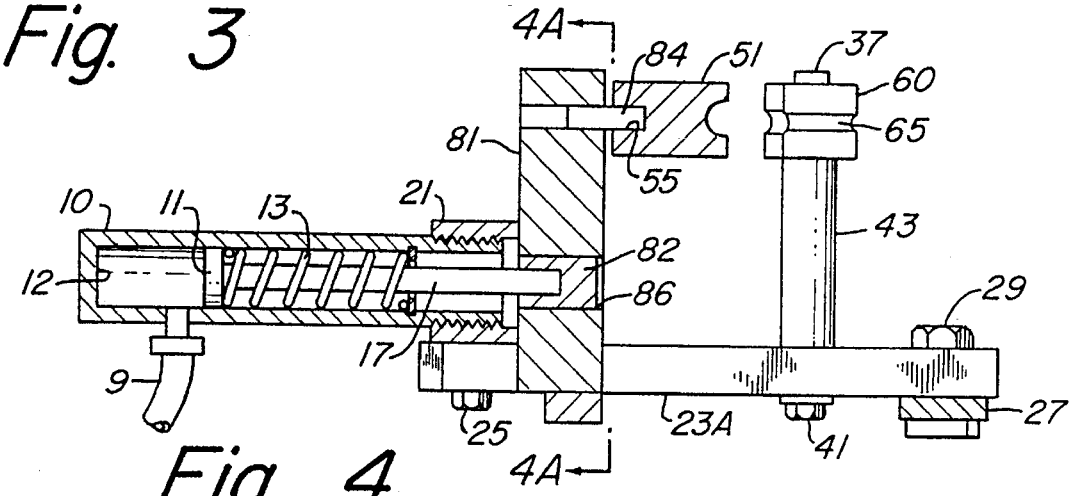
Fig. 4

HYDRAULIC TUBE BENDER

This application is a continuation-in-part of our prior application for patent Ser. No. 08/371,838, filed Jan. 12, 1995, now abandoned.

BACKGROUND OF THE INVENTION

1. Field of the Invention

This invention relates to improvements to hydraulic tube benders, and specifically to tube benders which use a center push mandrel to force a tube laterally between two bending dies to create a bend uniform on either side of the mandrel. More specifically, this invention relates to such devices capable of bending very light weight, thin walled tubing, such as titanium tubing used in aircraft.

2. Description of Related Art

Virtually every complex machine and vehicle in today's industrial society employs cylindrical tubing having one or more arcuate bends between end points. When such tubing fails or must be modified, the original bends usually must be replicated as part of the modification or repair. Often it is inconvenient, uneconomic or impossible to return to the original manufacturer for a duplicate or modified tube. Moreover, repair or modification projects often demand immediate substitution of tubes and cannot await research into availability. Considerable interest therefore exists for commonly available tube bending devices capable of bending tubing on demand from models at hand.

Of the devices on the market during recent decades to fill this need, all fall short of the ideal bender. Many cannot bend tubing into angles up to and including one hundred eighty (180°) degrees. Of those that can, most cannot accommodate complex bends in three dimensions, or multiple bends close together on one tube. A need exists for a hydraulic tube bender which can produce complex bends in three dimensions and closely spaced bends on a single tube.

Bending a tube to close tolerances involves careful observation of the bend while it is in progress. Without visual inspection of the contact point of the bending mandrel with the tube, the operator may fail to notice flaws developing in the tube walls, or create an imprecise bend angle. Though bends which fall short of the desired angle may be re-inserted for further bending, a bend which exceeds the desired angle cannot be straitened out without damage to the tube. A need exists for a tube bender which allows direct observation of the tube during bending.

Many tube benders available on the market satisfactorily may bend thick wall tubing such as automobile tail pipes and conduit, but much tighter tolerances and holding pressures are required to bend thin walled tubing such as that used in aircraft. Most benders not specifically designed for thin walled tubing will wrinkle or deform such tubing so that it fails to meet aircraft industry standards. One machine apparently capable of such bends appears in U.S. Pat. No. 5,339,670, issued to Granelli in 1994, but it obviously is bulky, stationary and likely very expensive. A need exists for an inexpensive, easily portable tube bender for thin walled tubing.

A few of the devices in the prior art deserve comment. Hawes (U.S. Pat. Nos. 1,505,887 and 1,530,261) provides portable conduit benders not of the center-push type. The primary shortcoming of such devices is that the precise location of the center of the bend cannot be determined in advance with accuracy. Mingori (U.S. Pat. No. 2,880,779) and Swanson (U.S. Pat. No. 3,018,818) provide center push benders, but rely upon top plates which obscure visibility during the bending operation and prevent closely spaced multiple angles on a single tube. They also rely upon round roller dies which can damage thin walled tubing. Owens (U.S. Pat. No. 5,237,847) also relies on round roller dies and provides a center push die which cannot create 180° bends because of its shape.

SUMMARY OF THE INVENTION

Accordingly, it is an object of this invention to provide a hydraulic tube bender with the following advantages:

(a) Inexpensive, portable, and quick and easy to use;

(b) Capable of bending close, multiple bends in any direction, including 180° bends, without tube damage;

(c) Providing open access to the top and bottom of the machine for visual inspection of the tube during the bending operation;

(d ) Allows the operator easily to copy existing bends;

(e) Provides a ready adjustment for bends of varying radii without interference from support plates and brackets; and (f) Capable or bending short radius bends in extremely thin walled tubing such as titanium aircraft tubing.

The foregoing and other objects of this invention are achieved by providing a hydraulic tube bender having a center-push mandrel propelled by a hydraulic cylinder mounted to a light-weight, portable work station stand. The cylinder is mounted to a block from which a pair of arms diverge on either side and below the mandrel and support two forming dies, one on either side of the centerline plane of the bender. The mandrel may be offset above the axis of the cylinder by an offset bracket, the bracket being braced against the bottom of the arms to prevent deformation during bending. A pneumatic cylinder also mounted to the block below the hydraulic cylinder may be tethered to the axles of the forming dies to provide dynamic resistance pressure to the tube during bending to prevent deformation of thin walled tubing.

BRIEF DESCRIPTION OF THE DRAWINGS

The novel features believed characteristic of the present invention are set forth in the appended claims. The invention itself, however, as well as a preferred mode of use and further objects and advantages thereof, will best be understood by reference to the following detailed description of an illustrative embodiment when read in conjunction with the accompanying drawings, wherein:

FIG. 2 shows a plan view of the bender viewed normal to the plane of the arms.

FIG. 3 shows a right side elevation of the bender of FIG. 2 absent the offset bracket shown of FIGS. 2 and 4.

FIG. 4 details a centerplane section of the bender as shown in FIG. 2, detailing the offset bracket which elevates the mandrel above the axis of the hydraulic cylinder.

DETAILED DESCRIPTION OF A PREFERRED EMBODIMENT

Figure 1:
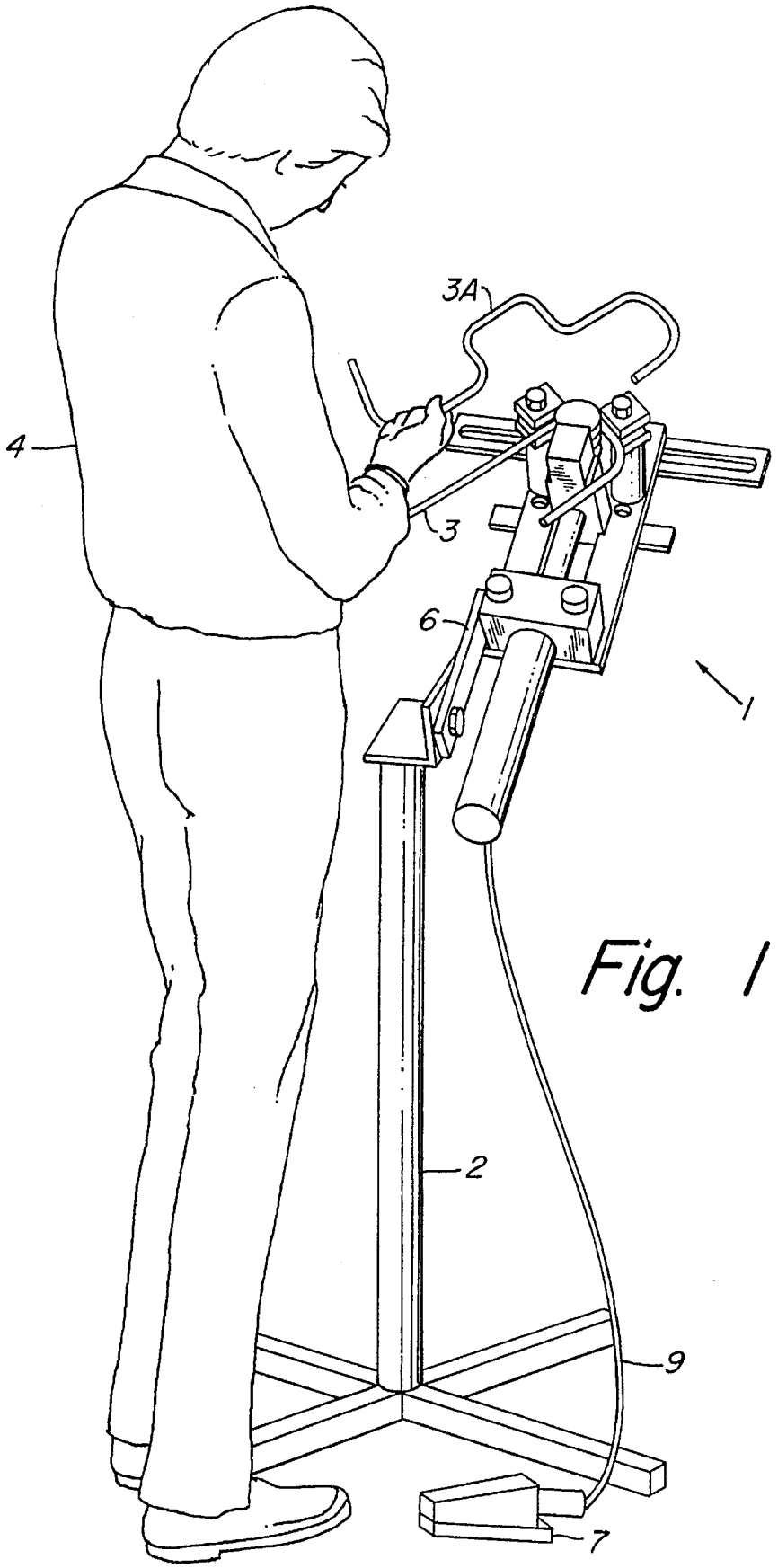
FIG. 1 depicts a perspective view of the tube bender of the present invention mounted on its portable work station stand.

With reference now to the figures, and in particular to FIG. 1, hydraulic tube bender 1 is depicted mounted on its portable work station stand 2 at a convenient angle to horizontal. Stand 2 is vertically adjustable using conventional telescoping means (not shown) to permit adjustment of stand 2 to elevate bender 1 to a convenient height for operator 4. Pump actuator 7 rests on the floor near stand 2 and is foot operated, freeing both hands of operator 4. Actuator 7 is coupled to bender 1 through hydraulic fluid hose 9. Operator 4 is depicted replicating a complex, three-dimensional bend in tube 3 from model tube 3A, which may be laid directly on top of tube 3 for convenient and easy gauging of the bending operation.

Figure 4A:
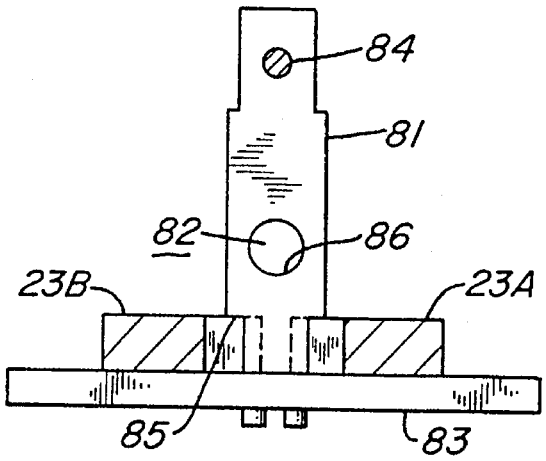
FIG. 4A is a front elevation of the offset bracket, taken at a section plane as indicated in FIG. 4.

Turning now to FIGS. 2 through 4, hydraulic tube bender 1 comprises block 21 mounted to stand 2 by means of plate 6. As detailed in FIG. 4, hydraulic cylinder 10 is coupled to block 21 and contains piston 11 adapted to reciprocate along longitudinal axis A of cylinder 10 for a substantial portion of its length. Rod 17, coupled to one side of piston 11 and surrounded by spring 13; reaches through the end of cylinder 10 opposite chamber 12 to the exterior of cylinder 10. Hydraulic fluid introduced under pressure from pump actuator 7 into chamber 12 forces piston 11 to compress spring 12 and causes rod 17 to extend outward from cylinder 10 along axis A. When fluid pressure is relieved using actuator 7, spring 13 automatically forces piston 11 back to its starting position, thereby retracting a substantial portion of rod 17 back into cylinder 10. Cylinder 10 preferably is rated nominally at least at two tons (4,000 pounds). A suitable cylinder is available as Model 801 from American Forge and Foundry (Intermarket, Inc.) of Guiderland, N.Y. A pump actuator matched to Model 801 is available as Model 814-41 from the same source. One having ordinary skill in the art will recognize that other pumps actuators and hydraulic cylinders could be employed without departing from the spirit and scope of the present invention.

NOTE: To distinguish them herein where convenient or necessary for clarity, corresponding and like parts on the left and right sides respectively of axis A are designated by the suffices A and B, as viewed from the top, cylinder end of bender 1.

Coupled to block 21 opposite cylinder 10 are two arms 23 diverging to form a plane parallel to but offset below axis A. The ends of arms 23 opposite block 21 are coupled through cross bracket 27 to hold them in a fixed position relative to a vertical centerline plane through axis A and normal to the plane of arms 23. Slide bolts 29 compress cross bracket 27 between arms 23 and nut 30, received within slot 28, to create a tight but easily adjusted tightening mechanism. Arms 23 bolt to block 21 but are capable of free swiveling, because block bolts 25 thread directly into arms 23 and are retained in place by nut 24. This mechanism may be tightened or loosened as desired to allow block bolts 25 freely to pivot through block 21 inhibited only by friction between block 21 and the head of block bolt 25 and the top surface of arm 23. This arrangement allows free pivoting while retaining rigid joint integrity and moment resistance needed for precise bending operations.

Figure 6A:
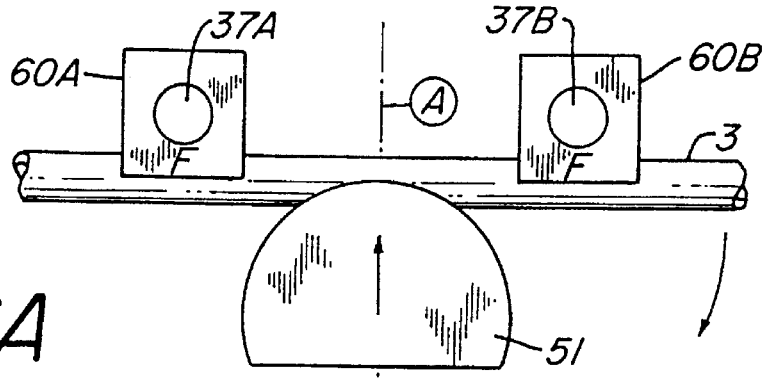
FIGS. 6A and 6B show a bending operation of the bender in FIGS. 2 and 4.

Such free pivoting is important because exact alignment of arms 23A, 23B equidistant from axis A is difficult by hand. With block bolts 25 free to pivot, and with slide bolts 29 loosened slightly, initial pressure on tube 3 by mandrel 51, as depicted in FIG. 6A, causes arms 23A, 23B to shift slightly until all transverse forces cancel. This assures that they are equidistant from axis A and that precisely equivalent longitudinal forces are being applied exactly normal to tube 3 by mandrel 51. Bolts 25, 29 then are tightened prior to beginning the bending operation.

Coupled to rod 17 and reciprocating therewith, mandrel 51 comprises a substantially semicircular block having top and bottom horizontal surfaces and an arcuate, vertical front face 52 opposite a flat rear face 56. Centered in rear face 56 is socket 55 adapted to receive rod 17 or pin 84, as discussed below. Semicircular channel 53 within front face 52 has a vertical cross sectional radius matching the outside diameter of a given size of tubing. The radius of the circle formed by the bottom of channel 53 (the radius of face 52 less the cross sectional radius of channel 53) defines the radius of a bend to be created in tube 3 using mandrel 51. One having ordinary skill in the art will recognize that mandrels of varying channel and bend radii may be provided to substitute for mandrel 51 in order to bend tubes of various diameters into bends of selected radii.

As seen in FIG. 3, mandrel 51 may be mounted directly onto rod 17 and reciprocate along axis A. Alternately, mandrel 51 may be mounted onto offset bracket 81 at a selected elevation above axis A, as seen in FIG. 4. Bracket 81 intercepts rod 17 at axis A and reciprocates with rod 17 while bearing mandrel 51 on pin 84. Adapter 82 enlarges the diameter of rod 17 to the size of aperture 86 in bracket 81. Inset 85 in the lower portion of bracket 81 receives arms 23 to permit them to close to parallel axis A. Bracket 81 slides atop the top surface of arms 23 while reciprocating along axis A. Brace 83 couples to the bottom of bracket 81 and bears against the bottom surface of arms 23 to reinforce bracket 81 and prevent moment forces which otherwise would be induced into rod 17 by a bending operation when bracket 81 is employed.

As seen in FIGS. 2 through 5, die posts 37 mount to arms 23 in post wells 31 at a selected distance from block 21 along arms 23. Die posts 37 are chosen to elevate forming dies 60 into the same plane as mandrel 51, taking into account whether or not offset bracket 81 is being employed. As seen in FIG. 4, the height of flange 43, which bears upon the top of arm 23 and supports die 60, varies to accomplish this. Die posts 37 are received into die post well 31 of arm 23 and secured from the bottom by bolt 41, which draws flange 43 down against the top surface of arm 21. Tight tolerances between well 31, flange 43 and die post 37 minimize rotation of die post 37 under moment forces induced by bending operations.

Figure 6B:
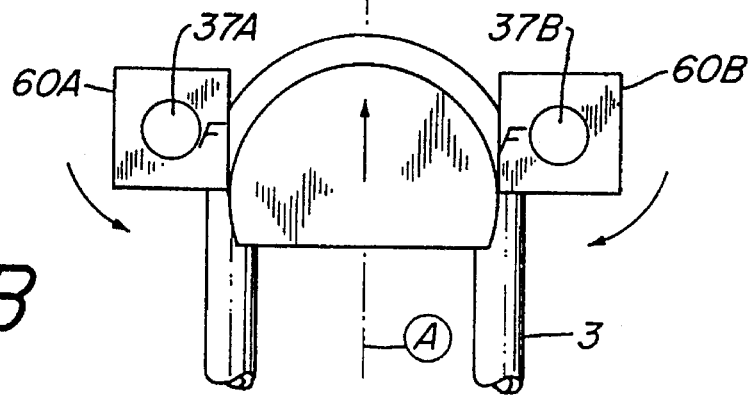
Figure 5:
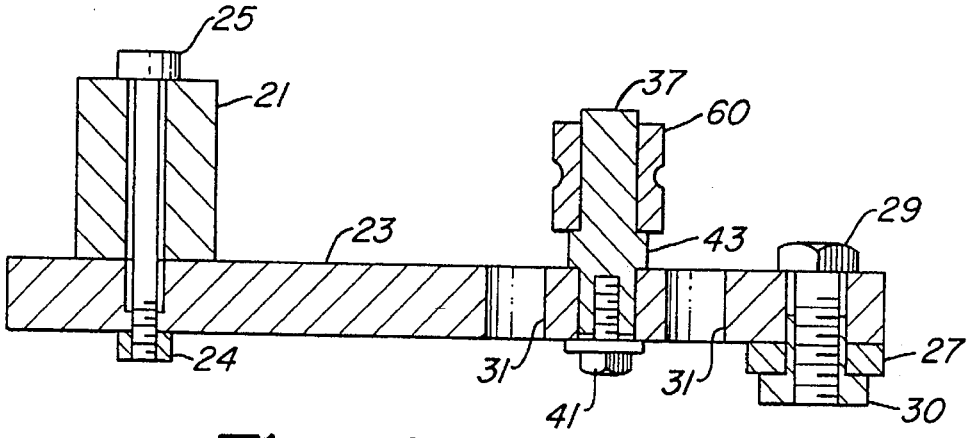
FIG. 5 shows a section through one of the arms of the bender shown in FIG. 2.

Forming dies 60 pivotally mount onto and freely spin about the axis of die posts 37. Dies 60 comprise substantially cubic cylinders having four vertical faces arranged in parallel pairs. Each face includes a horizontal groove 65 along its horizontal centerline, each groove 65 on a given die 60 having a radius matching the nominal outside diameter of one size of hydraulic tubing. A single set of dies 60A, 60B thus can accommodate four different tube sizes. Dies 60 are installed on die posts 37 in matching pairs, with the face F of a given tube size initially oriented transverse axis A and facing mandrel 51, as seen in FIG. 6A. The chosen groove size should match the selected channel 53 size on mandrel 51. In this fashion, the circumference of tube 3 is completely enclosed within channel 53 and die 60 when the latter is juxtaposed mandrel 51 (FIG. 6B). This supports tube 3 at the point where bending takes place, thereby supporting tube 3 and preventing undesired deformation of its cross section.

FIGS. 6A and 6B depict a typical bending operation. Initially, mandrel 51 is extended to a position between dies 60, similarly to FIG. 6B but absent tube 3. The angle of arms 23 is adjusted using cross bar 27 and slide bolts 29 until dies 60 abut mandrel 51. This assures that no excess space exists in which tube 3 could become wrinkled or crimped. Mandrel 51 then is retracted until tube 3 can be placed within groove 65 on both forming dies 60A, 60B so that it lies transverse axis A, and the faces F containing grooves 65 on dies 60A and 60B are aligned (FIGS. 6A). Cylinder 10 then is operated to move mandrel 51 forward to contact tube 3 equidistant between dies 60A, 60B. Operator 4 visually verifies that arms 23 remain symmetric about axis A and, if unsatisfied, adjusts cross bar 27 using slide bolts 29, block bolts 25, and pressure from mandrel 51 as discussed above. This adjustment assures that mandrel 51 will push directly perpendicular to tube 3 during the bending operation.

Once satisfied with the alignment, operator 4 operates actuator 7 to push mandrel 51 in between dies 60A, 60B. As mandrel 51 progresses, the contact between tube 3 and mandrel 51 expands along the length of tube 3 in opposite directions away from axis A. Simultaneously, dies 60A, 60B begin to rotate in opposite directions while continuing to bear against tube 3. If a bend large enough is needed, such as a 180° bend, mandrel 51 will move entirely between dies 60A, 60B, and faces F thereof containing the selected groove 65 matching channel 53 will be oriented parallel axis A and facing one another (FIG. 6B). If a less acute angle is desired, operator 4 may stop at any position inbetween. Tube 3 remains visible from the top during the entire bending operation, and operator 4 may lay a model or a protractor against tube 3 at any time to accurately measure the developing angle against the target. When operator 4 achieves the desired bend angle, he ceases operating actuator 7 and retracts mandrel 51, allowing him to remove tube 3.

Figure 7A:
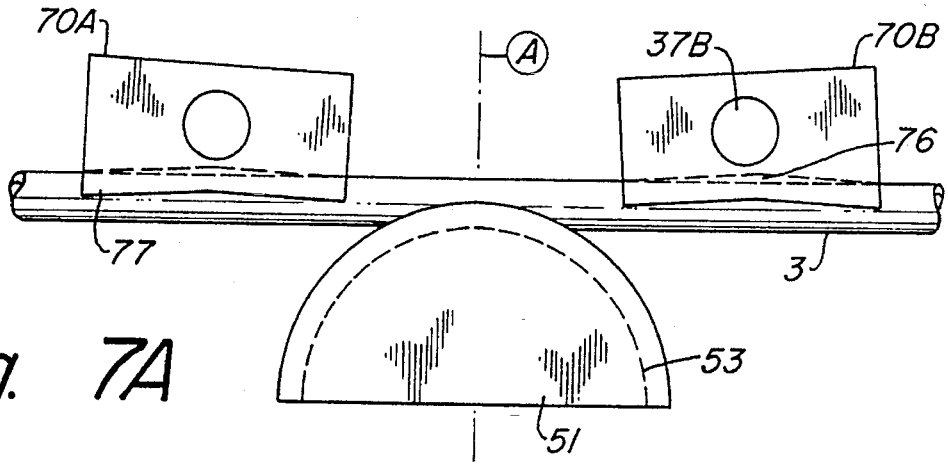
FIGS. 7A and 7B show an alternate embodiment of the forming dies and the operation thereof analogous to FIGS. 6A and 6B, respectively.
Figure 7B:
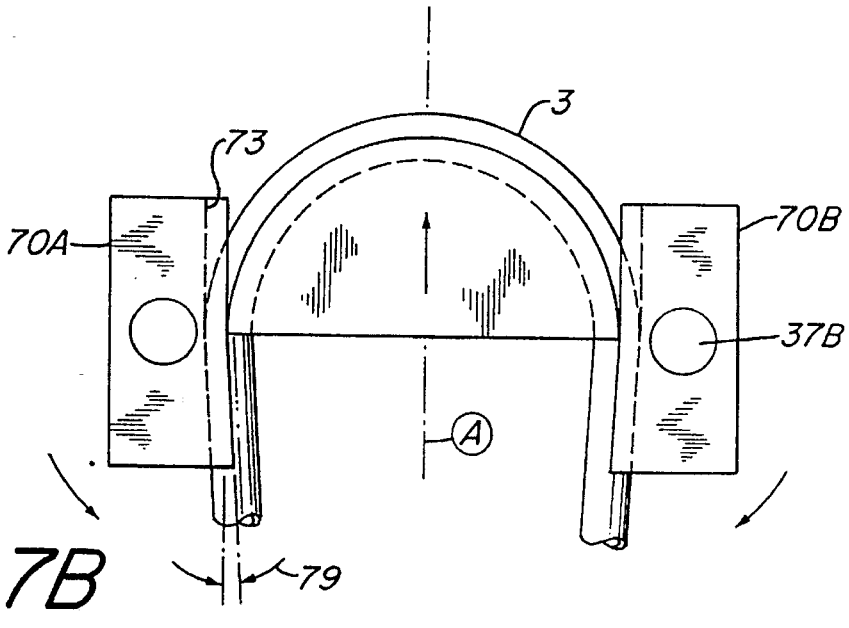
Figure 8:
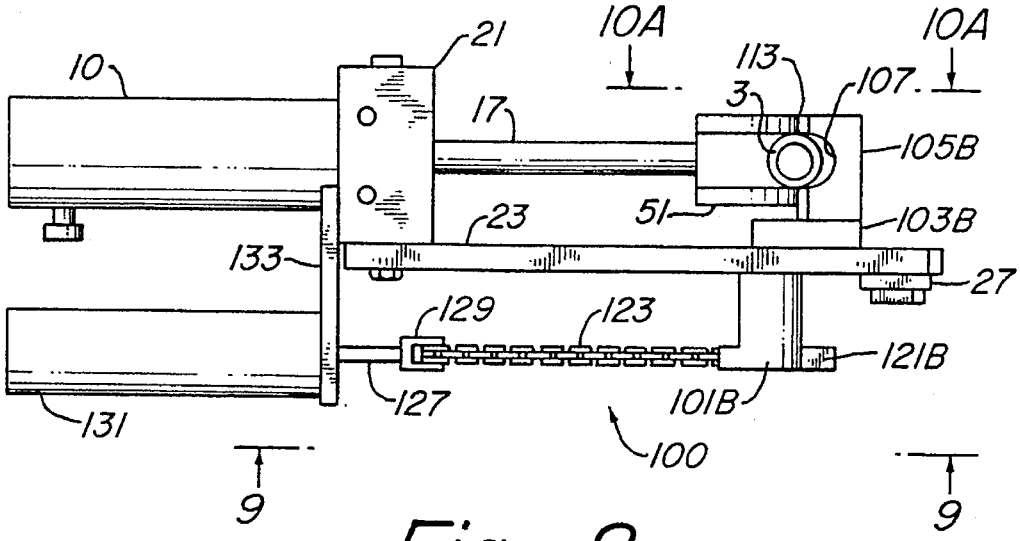
FIG. 8 details the right side elevation of an alternate embodiment of the bender of FIGS. 2 through 4 wherein the dynamic resistance option is included.
Figure 9:
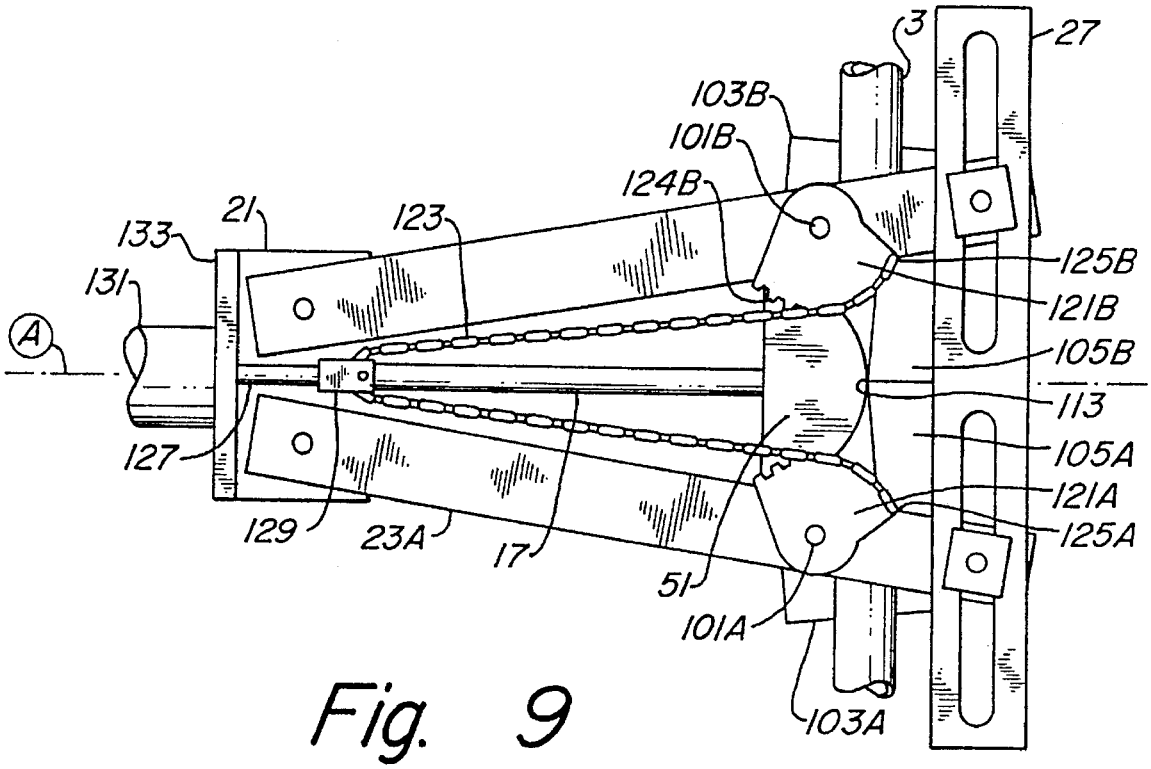
FIG. 9 is a bottom plan view of the bender of FIG. 8.

When operator 4 releases actuator 7 and retracts mandrel 51, elasticity of tube 3 causes it to spring open slightly. Normally, this is not significant enough to cause concern, and a slight overbend can be executed to compensate. If a true 180° bend is desired, however, overbending is not possible because dies 60 do not move inward. Where a 180° or greater bend is needed, specialized "kicker" forming dies 70 as depicted in FIGS. 7A and 7B may be used in lieu of dies 60. Flare 77 of die 70 overcomes the elasticity and spring-back problem by overbending tube 3 slightly beyond 180° when dies 70 lie on either side of mandrel 51 (FIG. 7B).

The face of each kicker die 70 containing groove 75 comprises two vertical planes intersecting at an obtuse angle (the compliment of angle 79 in FIG. 7B) near die post 37. Groove 75 follows flare 77 of die 70 and maintains a constant depth relative to the planes, thereby also having the same angle (note FIG. 7A showing gap 76 between groove 75 and tube 3 near die post 37). As seen in FIG. 7B, this angle and flare 77 forces tube 3 to wrap around mandrel 51 toward face 56 while mandrel 51 pushes tube 3 between dies 70A, 70B, thereby bending tube 3 beyond a full 180°. When operator 4 releases mandrel 51, tube 3 springs open slightly and settles at 180 degrees where it remains. To achieve this, angle 79 preferably is approximately five (5) degrees for typical steel tubing of small diameters. One having ordinary skill in the art will recognize that minor variations on angle 79 may be necessary for tubes having greater or lesser elasticity due to the materials from which they are made.

Figure 10A:
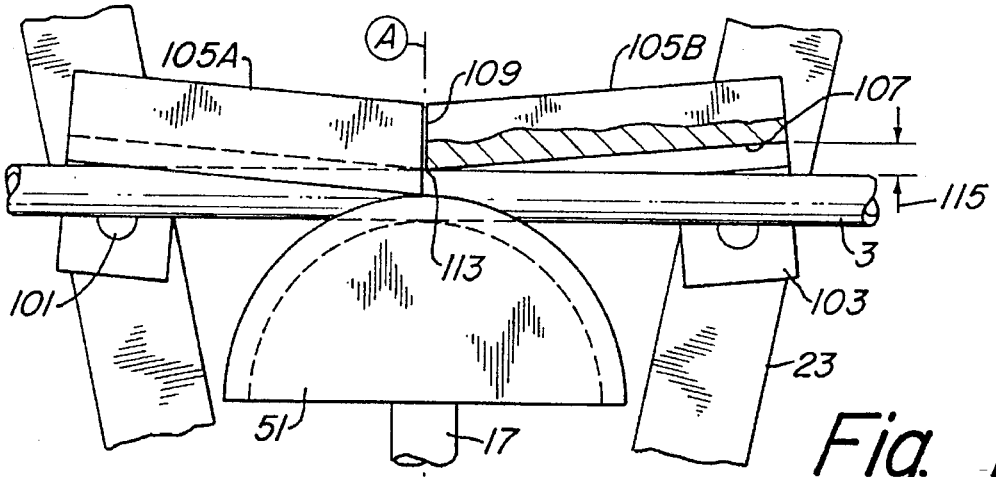
FIGS. 10A and 10B detail the bending operation of the bender of FIGS. 8 and 9.
Figure 10B:
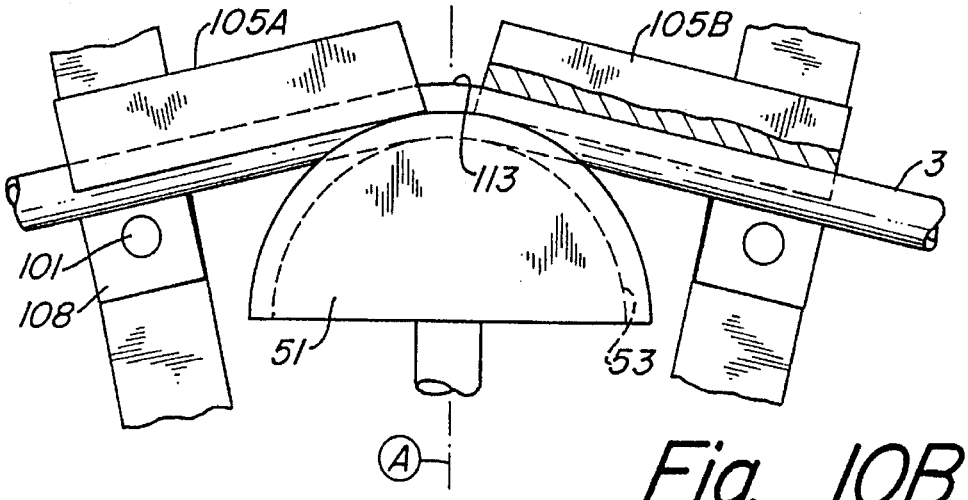

An alternate embodiment to the forgoing is depicted in FIGS. 8 through 10B. Dynamic resistance means 100 is an optional attachment which adapts bender 1 especially to thin walled tubing. Die posts 37 have been replaced with axles 101 extending through arms 23 at wells 31. Flange 103 limits axial movement of axle 101 by bearing against the top surface of arm 23 and carries levered forming die 105. Lever die 105 is fixed to flange 103 instead of being free to rotate as are dies 60, 70, and bears against mandrel 51 at point 113. As seen in FIGS. 10A, 10B, lever dies 105 initially do not lie parallel to tube 3, but bear against it only at point 113 where dies 105 contact mandrel 51. Bevel 109 is provided in the end of lever dies 105 to permit points 113 to abut with substantially no space between lever dies 105. Gap 115 remains between lever die 105 and tube 3 at the axle end of lever die 105. As mandrel 51 progresses along axis A to move between lever dies 105, lever dies 105 pivot axle 101 until gap 115 disappears and tube 3 lies entirely within groove 107, where it remains during the rest of the bending operation. This creates a decided advantage in containing tube 3 and preventing it from deforming.

To successfully bend tube 3, lever die 105 must stretch the metal of tube 3 on its side opposite mandrel 51 while compressing the metal bearing against mandrel 51. If any gap is allowed between tube 3 and mandrel 51, the excess metal may deform into the gap and wrinkle tube 3. This is especially likely to occur if the metal has very little length to width (L/R) ratio, as in very thin walled tubing. If the metal is confined to a semicircular space, however, it will not wrinkle. As the bend progresses, the point where the bend is developing travels away from point 113 and along die 105 and robe 3. Since lever die 105 bears upon the entire length of tube 3, it always bears against the bend point as it travels away from point 113. At the same time, though, lever die 105 continues to bear against already bent portions of tube 3, preventing them from escaping channel 53 and groove 107, thereby suppressing wrinkling.

Lever dies 105 are dynamically leveraged against mandrel 51 rather than simply being passively resistant as are dies 60, 70 mounted on die posts 37. This is achieved by operation of torque means 120 mounted under arms 23. Quarterplates 121 are mounted rigidly to axles 101 beneath arms 23 and comprise a quarter circle enlargement thereof extending toward axis A in a plane parallel arms 23. Affixed to corner 125A of quarterplate 121A is tether means 123 comprising a metal link chain similar to that used in bicycles and chain saws. Suitable track means such as teeth 124 keep chain 123 in place on plates 121. Chain 123 loops through pulley 129 and back to corner 125B of quarterplate 121B on axle 101B. Pulley 129 is coupled to rod 127 of pneumatic cylinder 131, which is bolted to block 21 by drop plate 133.

Air introduced into pneumatic cylinder 131 forces rod 127 to be retracted into cylinder 131, applying tension to chain 123 and tending to rotate corners 125 toward pulley 127. This applies torque to axles 101, thereby causing points 113 to bear upon tube 3 where it contacts mandrel 51 at axis A. As mandrel 51 moves forward along axis A, pneumatic cylinder 131 resists its motion because of the torque induced into axles 101 by chain 123. Of course, the compressible air in cylinder 131 cannot overcome the hydraulic fluid in cylinder 10, so torque means 120 cannot stop mandrel 51. In this fashion, lever dies 105 deliver a dynamic resistance throughout the bending operation. In fact, this resistance increases as the bending operation progresses because quarterplates 121 rotate and draw rod 127 out of cylinder 13 1 against back resisting air pressure. This increased resistance is in contrast to the decreasing pressure from passive resistance by die posts 37, which only react to pressure from mandrel 51 and supply no torque of their own. Pulley 129 and the circular shape of quarterplates 121 assure that tension in chain 123 applies equal and constant torque to axles 101.

Pneumatic cylinder 131 preferably has a minimum of a two (2") inch bore and a six (6") stroke and operates on 60 to 90 psig delivered by a suitable air compressor (not shown). A suitable pneumatic cylinder 131 is available as SpeedAire Model 6W148 from Dayton Electric Manufacturing Company of Chicago, Ill.

As the vector direction of the force applied by lever dies 105 rotates from parallel axis A (FIG. 10A) to substantially transverse axis A (FIG. 10B), drag from friction against tube 3 sometimes may squeeze it forward ahead of mandrel 51 and allow it to escape from channel 53. This seldom occurs on small radius tubing, but in larger tubing it can cause crimping of tube 3. To prevent this, a clamp (not shown) may be applied in gap 109 between dies 105, causing points 113 of dies 105 to be apart by the width of the clamp at the beginning of the bending operation. A suitable clamp is fully described in Goldberg, U.S. Pat. No. 4,005,593. Preferably, however, an adjustable clamp of narrower width may be provided which minimizes the obscuring of tube 3.

Interestingly, testing has revealed that groove 107 actually is unnecessary for some tubes as long as sufficient torque is applied to lever dies 105. In such case, the surface contact is reduced to a tangent line along the length of tube 3 opposite mandrel 51. This demonstrates that it is the radial force applied against tube 3, and not the friction caused by such force, which achieves the desired results. In fact, lubrication of groove 107 is useful to prevent erosion of dies 105 from multiple operations. In extremely thin walled tubing, however, groove 107 is highly desirable to guard against tube wall collapse, a completely different phenomenon from wrinkling or kinking.

While the invention has been particularly shown and described with reference to a preferred embodiment, it will be understood by those skilled in the art that various changes in form and detail may be made therein without departing from the spirit and scope of the invention. For example, round dies could be employed in lieu of cubic dies 60 for tubing of many wall thicknesses. Also, though kicker die 70 is substantially rectangular instead of square as is die 60, and it includes only one groove 75 as depicted and discussed above, a multi-groove kicker die (not shown) certainly is feasible and could be provided.

We claim:

1. A hydraulic tube bender comprising a hydraulic cylinder having a piston rod extending forward from one end thereof, the rod adapted to reciprocate along a longitudinal axis of the cylinder in response to changes in oil pressure within the cylinder;

a rigid offset bracket coupled to the rod and adapted to reciprocate therewith, the bracket having a stud vertically offset above the rod;

a mandrel coupled to the stud and defining a first plane parallel to the axis, the mandrel having a curved surface normal to the first plane, the curved surface further having a groove adapted to receive and bear against a tube;

a block coupled to the cylinder:

a pair of arms pivotally coupled to and extending forward from the block in a second plane offset below and parallel the first plane: and forming die means coupled to the arms a select distance from the cylinder and having two forming surfaces coplanar with the groove, one each of the forming surfaces positioned on either side of the axis, for forming the tube in response to pressure exerted through the mandrel by the cylinder rod, whereby the tube bender may cause the mandrel to push the tube between the forming surfaces, thereby bending the tube around the mandrel and into a selected angle in the first plane.

2. The hydraulic tube bender according to claim 1 wherein the bracket further comprises a brace coupled to the bracket and extending below the arms transverse the axis for bracing the bracket against the arms.

3. The hydraulic tube bender according to claim 1 and further comprising positioning means for adjustably positioning the forming surfaces equidistant from the axis.

4. The hydraulic tube bender according to claim 3 wherein the positioning means comprises a cross bar disposed transverse the axis and coupled to the ends of the arms opposite the block, the cross bar having a plurality of openings disposed along its length;

sliding bolt means received within two of said openings, each sliding bolt means coupled to an arm and adapted to affix an arm to the cross bar at a one or more selected positions along the cross bar.

5. The hydraulic tube bender according to claim 1 wherein the forming die means further comprises a pivot axle coupled to and extending through each of the arms;

a forming die rigidly mounted to each of the pivot axles, the forming die being coplanar with the mandrel and bearing a forming surface normal to the first plane;

torque means coupled to the pivot axles for applying torque to the pivot axle.

6. The hydraulic tube bender according to claim 5 wherein the torque means comprises two arcuate plates, one each mounted to one of the pivot axles, the plates defining a third plane parallel to and offset below the second plane;

a pneumatic cylinder coupled to the block and having a pneumatic piston rod adapted to reciprocate in the third plane in response to pneumatic pressure changes in the pneumatic cylinder;

a pulley mounted to the end of the pneumatic piston rod; and tether means extending from one arcuate plate through the pulley to the other arcuate plate, for tethering the tracks to the pneumatic piston rod, whereby the pneumatic cylinder applies torque uniformly to each of the pivot axles through the tether means in response to pressure in the pneumatic cylinder.

7. The hydraulic tube bender according to claim 1 wherein the forming die means further comprises kicker die means having a flare surface intersecting and disposed adjacent the forming surface opposite the axis, for overbending the tube to compensate for elasticity.

8. A hydraulic tube bender comprising a hydraulic cylinder having a piston rod extending forward from one end thereof, the rod adapted to reciprocate along a longitudinal axis of the cylinder in response to changes in oil pressure within the cylinder;

a block coupled to the cylinder;

a pair of arms pivotally coupled to and extending forward from the block in a first plane offset below and parallel the axis;

a rigid offset bracket coupled to the rod forward of the block, the bracket having an aperture receiving the piston rod and a stud vertically offset above the aperture, a brace coupled to the bracket below the arms and extending transverse the axis;

a mandrel coupled to the stud and defining a second plane parallel to and offset above the axis, the mandrel having a curved surface normal to the first plane, the curved surface further having a groove adapted to receive and bear against a tube;

forming die means coupled to the arms a select distance from the cylinder and having two forming surfaces coplanar with the groove, one each of the forming surfaces positioned on either side of the axis, for forming the tube in response to pressure exerted through the mandrel by the cylinder rod, whereby the tube bender may cause the mandrel to push the tube between the forming surfaces, thereby bending the tube around the mandrel and into a selected angle in the first plane.

9. The hydraulic tube bender according to claim 8 wherein the forming die means further comprises a pivot axle coupled to and extending through each of the arms;

a forming die rigidly mounted to each of the pivot axles, the forming die being coplanar with the mandrel and bearing a forming surface normal to the first plane;

two arcuate plates, one each mounted to one of the pivot axles, the plates defining a third plane parallel to and offset below the first plane;

a pneumatic cylinder coupled to the block and having a pneumatic piston rod adapted to reciprocate in the third plane in response to pneumatic pressure changes in the pneumatic cylinder;

a pulley mounted to the end of the pneumatic piston rod; and tether means extending from one arcuate plate through the pulley to the other arcuate plate, for tethering the tracks to the pneumatic piston rod, whereby the pneumatic cylinder applies torque uniformly to each of the pivot axles through the tether means in response to pressure in the pneumatic cylinder, causing the forming dies to apply pressure to the tube and against the mandrel.

10. A dynamic pressure adapter for a center-push tube bender, the tube bender having a mandrel reciprocating along a longitudinal axis, pressure means for causing the mandrel to reciprocate, two forming die means coplanar with the mandrel, and positioning means for positioning the forming die means on opposite sides of the axis, the dynamic pressure adapter comprising pivot axis rigidly coupled to the forming die means;

two arcuate plates, one plate rigidly coupled to one of the pivot axles, the plates defining a plane parallel to and offset below the axis:

a pneumatic cylinder coupled to the positioning means and having a pneumatic piston rod adapted to reciprocate in the plane in response to pressure changes in the pneumatic cylinder;

a pulley mounted to one end of the pneumatic piston rod; and tether means extending from one arcuate plate through the pulley to the other arcuate plate, for tethering the plates to the pneumatic piston rod, whereby the pneumatic cylinder applies torque uniformly to each of the forming dies through the tether means and the pivot axles in response to pressure in the pneumatic cylinder, thereby causing the forming dies to apply pressure to the tube and the mandrel.

11. A dynamic pressure adapter for a center-push tube bender, the tube bender having a mandrel reciprocating along a longitudinal axis, pressure means for causing the mandrel to reciprocate, two forming die means coplanar with the mandrel and positioning means for positioning the forming die means on opposite sides of the axis, the positioning means further having two arms extending forward of the pressure means in a plane parallel and offset below the axis, the arms having a plurality of wells disposed along a length of the arms at selected distances from the pressure means, the wells being adapted to receive the pivot axles and a cross bar disposed transverse the axis across and adjustably coupled to the arms, the dynamic pressure adapter comprising:

pivot axles rigidly coupled to the forming die means, torque means coupled to each of the pivot axles for applying torque to the axles.

12. An improved method of bending tubing comprising the steps of providing a tube bender having a mandrel means adapted to reciprocate along a longitudinal axis in a first plane;

pressure means for causing the mandrel to reciprocate;

a positioner coupled to the pressure means;

two pivot axles coupled to the positioner on opposite sides of the axis;

two forming dies, one coupled to each of the pivot axles, each die having at least one forming surface coplanar with the mandrel;

two arcuate plates, one coupled to each of the pivot axles opposite the forming dies;

a tether coupled to the arcuate plates; and resistance means coupled to the tether for applying torque resistance to the forming dies through the tether, the arcuate plates and the pivot axles;

positioning a tube between the mandrel and the forming die; then operating the pressure means to cause the mandrel to push the tube toward and to engage the forming dies; then operating the resistance means to apply resistive torque through the forming dies against the tube; then operating the pressure means to force the tube to move between the forming dies, thereby bending the tube into a selected angle in the first plane.

13. A hydraulic tube bender comprising a hydraulic cylinder having a piston rod extending forward from one end thereof, the rod adapted to reciprocate along a longitudinal axis of the cylinder in response to changes in oil pressure within the cylinder;

a mandrel coupled to the rod and defining a first plane parallel to the axis, the mandrel having a curved surface normal to the first plane, the curved surface further having a groove adapted to receive and bear against a tube;

a block coupled to the cylinder;

a pair of arms pivotally coupled to and extending forward from the block in a second plane offset below and parallel the first plane;

forming die means coupled to the arms a select distance from the cylinder and having two forming surfaces coplanar with the groove, one each of the forming surfaces positioned on either side of the axis, for forming the tube in response to pressure exerted through the mandrel by the cylinder rod: and a rigid offset bracket coupled between the rod and the mandrel, the bracket having an aperture receiving the piston rod and a stud vertically offset above the aperture and received within the mandrel, whereby the mandrel and the first plane are offset above the axis a selected distance and whereby the tube bender may cause the mandrel to push the tube between the forming surfaces, thereby bending the tube around the mandrel and into a selected angle in the first plane.

14. A hydraulic tube bender comprising a hydraulic cylinder having a piston rod extending forward from one end thereof, the rod adapted to reciprocate along a longitudinal axis of the cylinder in response to changes in oil pressure within the cylinder:

a mandrel coupled to the rod and defining a first plane parallel to the axis, the mandrel having a curved surface normal to the first plane, the curved surface further having a groove adapted to receive and bear against a tube;

a block coupled to the cylinder;

a pair of arms pivotally coupled to and extending forward from the block in a second plane offset below and parallel the first plane;

a pivot axle coupled to and extending through each of the arms;

a forming die rigidly mounted to each of the pivot axles, the forming die being coplanar with the mandrel and bearing a forming surface normal to the first plane;

two arcuate plates, one each mounted to one of the pivot axles, the plates defining a third plane parallel to and offset below the second plane;

a pneumatic cylinder coupled to the block and having a pneumatic piston rod adapted to reciprocate in the third plane in response to pneumatic pressure changes in the pneumatic cylinder;

a pulley mounted to the end of the pneumatic piston rod; and tether means extending from one arcuate plate through the pulley to the other arcuate plate, for tethering the tracks to the pneumatic piston rod.

15. An improved method of bending tubing comprising the steps of providing a tube bender having a mandrel means adapted to reciprocate along a longitudinal axis in a first plane;

pressure means reciprocating in a second plane for causing the mandrel to reciprocate;

an offset bracket coupled between the mandrel means and the pressure means;

a positioner coupled to the pressure means;

two forming dies, one each coupled to the positioner on opposite sides of the axis, each die having at least one forming surface coplanar with the mandrel; and torque means coupled to the forming dies for applying torque to the forming die;

positioning a tube between the mandrel and the forming die; then operating the pressure means to cause the mandrel to push the tube toward and to engage the forming dies; then operating the torque means to apply resistive torque through the forming dies against the tube: then operating the pressure means to force the tube to move between the forming dies, thereby bending the tube into a selected angle in the first plane.

* * * * *